US008474617B2

(12) United States Patent
Wiedmann et al.

(10) Patent No.: US 8,474,617 B2
(45) Date of Patent: Jul. 2, 2013

(54) STACKABLE AND NESTING BOTTLE CASE

(75) Inventors: Hans Joachim Wiedmann, Berlin (DE); Marcus Wille, Hameln (DE); Martin Fetzer, Ottenhofen (DE)

(73) Assignee: Schoeller Arca Systems GmbH, Schwerin (DE)

( * ) Notice: Subject to any disclaimer, the term of this patent is extended or adjusted under 35 U.S.C. 154(b) by 0 days.

(21) Appl. No.: 13/810,052

(22) PCT Filed: May 23, 2011

(86) PCT No.: PCT/EP2011/002560

§ 371 (c)(1), (2), (4) Date: Jan. 14, 2013

(87) PCT Pub. No.: WO2012/010232

PCT Pub. Date: Jan. 26, 2012

(65) Prior Publication Data

US 2013/0112582 A1 May 9, 2013

(30) Foreign Application Priority Data

Jul. 21, 2010 (DE) ..... 10 2010 031 770

(51) Int. Cl.
*B65D 21/04* (2006.01)

(52) U.S. Cl.
USPC ..... 206/427; 206/507

(58) Field of Classification Search
USPC .. 206/139, 140, 427, 503, 505, 507; 220/509, 220/515, 516
See application file for complete search history.

(56) References Cited

U.S. PATENT DOCUMENTS

| | | | | |
|---|---|---|---|---|
| 3,613,943 | A * | 10/1971 | Bridenstine | 206/507 |
| 4,205,749 | A * | 6/1980 | Carroll et al. | 206/507 |
| 4,911,303 | A * | 3/1990 | Andersson | 206/509 |
| 4,993,554 | A * | 2/1991 | Box | 206/507 |
| 5,752,602 | A * | 5/1998 | Ackermann et al. | 206/507 |
| 8,292,078 | B2 * | 10/2012 | Cook et al. | 206/506 |
| 2007/0034540 | A1 * | 2/2007 | Dubois | 206/507 |
| 2008/0116100 | A1 * | 5/2008 | Hassell et al. | 206/507 |
| 2009/0250369 | A1 * | 10/2009 | Guibert et al. | 206/507 |

* cited by examiner

*Primary Examiner* — Jacob K Ackun
(74) *Attorney, Agent, or Firm* — Gerald E. Helget; Briggs and Morgan, P.A.

(57) ABSTRACT

The invention relates to a bottle case (10, 10'), including a case base (11), four side elements (12, 13, 14, 15) extending from the base, and a framework (16) having compartments (17) for accommodating bottles, wherein the bottle case (10, 10') also has a mechanism (20) on at least two opposite side elements and on the case base for rotated stacking of a plurality of bottle cases. The bottle case (10, 10') is suitable for transporting bottles whether the bottles are full or empty and for transporting the cases back and forth in an empty state.

9 Claims, 7 Drawing Sheets

STACKABLE AND NESTING BOTTLE CASE

CROSS-REFERENCE TO RELATED APPLICATIONS

The present invention is a national phase application of PCT/EP2011/002560 which claims priority to DE 10 2010 031 770.5, filed Jul. 21, 2010.

BACKGROUND OF THE INVENTION

The invention relates to a bottle crate according to the preamble of patent claim 1.

Bottle crates typically have a crate base which supports a framework for receiving bottles and for sidewalls that are permanently connected to the base and circumferentially arranged, so that stable and rattle free transport of filled bottle cases to a location of use is provided. Securing the bottles through the framework is therefore necessary in order to prevent damages, for example to gas bottles, through jolts or impacts, and to prevent the bottles from tipping over and furthermore to substantially prevent rattling so that respective rattling noises are avoided.

Due to mandated bottle refund and/or bottle return systems, a respective collection of empty bottles for return transportation has to be provided at vending locations for beverage bottles. This poses difficulties at numerous vending locations, in particular supermarkets, but also beverage stores, since various bottles are returned to this vending location empty, wherein the bottles differ from one another in height, diameter or similar, but still have to be received and returned. Often, suitable cases or containers for such return transportation are not provided. Therefore, empty bottles of this type are often placed in any containers for return transportation which oft leads to a destruction of bottles. Additionally, the containers with the empty material have to be transported to local collection sites where the different containers themselves cannot be used and therefore simply have to be disposed of.

Furthermore, yogurt beakers that are stackable with 180° offset are known from DE 195 10 084 C1, basket crates that are stackable with 180° offset are known from DE 920 5 337 U1, bottles crates that are stackable with 90° offset are known from DE 20 2004 009 031 U1, and DE 920 3 805 U1, bottle crates that are stackable with an offset are known from US 2005 02 30 281 A1, bottle crates that are stackable with a 180° offset are known from U.S. Pat. Nos. 6,082,542 A and 4,304, 334 A.

SUMMARY OF THE INVENTION

Thus, it is an object of the invention to provide a bottle case with a respective framework for receiving bottles which is suitable on the one hand side for transporting bottles no matter whether they are filled or empty and on the other hand side is also suitable for return- and outbound transportation in empty condition. By the same token, the bottle case shall be configured in particular stable and with low weight.

This object is achieved by a bottle crate according to claim 1, wherein advantageous embodiments of the invention are characterized by the features included in the dependent claims.

The object is achieved in particular by a bottle case including a base, four side elements essentially extending from the base in vertical direction and a framework with compartments for receiving bottles. The side pieces are configured substantially open. Furthermore, the bottle case includes a mechanism at least at two opposite side elements and at the base of the case for stacking plural bottle cases in a rotated arrangement, wherein the mechanism is configured so that an upper bottle case

- is applicable to a lower bottle case in a placement position; and
- is insertable into the lower bottle case in a nesting position in an orientation that is rotated about a vertical axis preferably by 180° with respect to the placement location, wherein the mechanism includes
- at least one column element protruding into an interior of the case respectively at least at two side elements arranged opposite to one another, and
- at least one edge recess at the base of the case respectively arranged at the two opposite side pieces, wherein the edge recess is adapted to the column element, wherein the column element and the recess of each side element are arranged so that in the placement position the column elements of the upper bottle case are alignable with the column elements of the lower bottle case so that the column elements of the upper bottle case are applicable to the column elements of the lower bottle case and in the nesting position, the column elements of the lower bottle case are alignable with the respective recesses of the upper bottle case and thus receivable in the respective recess of the upper bottle case, wherein the column elements essentially form the side elements of the bottle case, wherein the column elements are connected with one another through a circumferential frame element at an upper end of the bottle case, wherein the side elements are configured open.

The side elements are configured for example as two longitudinal side elements or long side elements and two face side elements or short side elements.

It is an essential feature of the invention that the bottle case is stackable in the placement position when loaded with empty product, so that the empty product of a bottle case arranged there above is not impaired. Furthermore, a case can also be inserted deeper in the nesting position into a case arranged thereunder, so that the case can be stored and also transported in a space saving manner when no empty material is included. A rotation axis in this sense is an axis that extends vertically upward from the ground when the bottle case is being used.

Preferably the mechanism is configured so that the lower and the upper bottle case are arranged in the same orientation in the placement position and are arranged in the nested position in rotated alignment relative to one another.

In a preferred embodiment, the mechanism is configured so that the upper bottle case is applicable to the framework of the lower bottle case and insertable into the lower bottle case or so that at least a placement element is provided which prevents a placement of the upper bottle case onto the framework of the lower bottle case in the nested position.

Preferably at least two or a plurality of column elements are provided at each of the opposite side elements and at least two or a plurality of edge recesses at the case base adapted to the column elements are provided at each of the two side elements arranged opposite to one another. All four side elements can thus include column elements and recesses.

A case plane which is arranged parallel to the case base can be divided for example into four quadrants according to a coordinate system. Each quadrant preferably includes respective column elements and recesses, wherein the column elements are arranged at a side element so that a column element meets a column element and a recess meets a recess when two cases are stacked on top of one another in placement position. In the nested position the column elements meet the respective recesses. For example, at a longitudinal side element in quadrant I, recess-column element-recess are arranged, directly opposite to one another (at the opposite longitudinal side element) also in quadrant IV recess-column element-recess are arranged. In quadrant II, however, column element-recess-column element are also arranged, directly opposite in quadrant III also column element-recess-column element are arranged. The positions of the particular column elements and recesses are in turn mirror symmetrical with respect to the mirror planes which respectively extend in the center between the opposite side elements.

Thus, either the column elements can be brought into alignment with one another (placement position) or the column elements and respective recesses can be brought into alignment with one another (nested position). In the placement position, also the recesses of the upper case and the lower case are arranged in alignment with one another, though this does not influence stacking.

It is certainly also feasible to provide at least one column element at all four respective side elements (including the respective recesses). Thus, the lower bottle case includes at least four contact surfaces for the upper bottle case and the upper bottle case is supported in a stable manner on the lower bottle case. Thus, for a stable structure of the case, plural columns are arranged at the side elements, preferably at all side elements.

This means in the same orientation of the cases (placement position), the column elements of upper and lower bottle case are applicable on top of one another and the upper bottle case sits on the lower bottle case essentially without sinking into the lower case. In the best scenario, the upper case slightly sinks into the lower case, namely when the column elements of the lower case do not reach to its upper edge.

A rotation of the upper bottle case by 180° with reference to the lower bottle case (and thus with reference to the placement position) about an axis which extends vertically upward from the case base has the effect that the column elements of the upper bottle case cannot be brought into alignment anymore with the column elements of the lower bottle case. Rather, the column elements of the lower bottle case slide into the respective recesses at the case base of the upper case when the upper case is placed on the lower case, or the recesses of the upper case receive the column elements of the lower case and the nesting position is reached.

In the nesting position, the upper bottle case advantageously lies on the framework of the lower bottle case, wherein the framework has a lower height from the case base than the column elements. This means the column elements extend from the base along the side elements beyond the framework.

An explicit contact element or several of them can also be provided, wherein the second bottle case is applicable on the contact element. Advantageously also this contact element extends beyond the framework so that a placement of the upper bottle case onto the framework of the lower bottle case is prevented and the framework is preserved. This takes into consideration that frameworks often have a fragile structure. The contact elements protect the framework arranged thereunder.

Additional corner column elements increase the stability of the bottle case. Also these have to be arranged accordingly so that an applied position and a nesting position are facilitated.

Each of the column elements advantageously extends during use from the base essentially in vertical direction upward, wherein respectively the lower and the upper face of the column element are configured as contact surfaces. Thus, in the applied position, the contact surfaces of the column elements are used for receiving the stacked bottle cases. The upper bottle case thus rests on the contact surfaces of the column elements of the lower bottle case. The lower faces are essentially formed by the case base.

For easier transportation, it is helpful to configure the case in light weight construction and thus reduce the weight as much as possible. Thus, the side elements can only be formed by the column elements, this means the column elements essentially form the side elements of the bottle case, wherein the column elements are connected with one another at an upper end of the bottle case with a circumferential frame element. Additional elements can be provided which jointly form the side elements, in particular for stabilization.

Preferably, each of the column elements is configured as a hollow element, preferably with a triangular cross-section, particularly preferably with a roof shaped structure whose roof gable extends into the interior of the bottle case. Also the hollow configuration of the column elements helps to configure the case in light weight construction.

In order to still provide a sufficient stability of the arrangement, the hollow column element includes at least one reinforcement rib in its interior. The reinforcement rib extends preferably essentially transversal to the extension of the column element (transversal rib) and is preferably centrally arranged. Thus, the stability of the column element and therefore of the bottle case can be further increased.

An advantageous embodiment provides that the height of the framework is less than ½ the height of the side elements of the bottle case, preferably 0.2 to 0.4 times the height of the side element. This height is sufficient to safely transport empty material. Simultaneously the framework has sufficient height to facilitate the nesting position.

Preferably, the bottle case is made from a plastic material which on the one hand side provides durability and on the other hand side supports the light weight construction.

It would also be possible to configure the mechanism so that column elements protruding into the interior of the case are provided at least at two opposite side elements, wherein each of the column elements is arranged opposite to an adapted edge side recess at the case base at the opposite side element. With reference to a side element, the recesses and column elements are arranged e.g. symmetrical to a mirror or symmetry plane which in turn extends centrally between the two opposite side elements. Thus, the column elements of the upper bottle case can be placed on the column elements of the lower bottle case in the placement position. In the nesting position, the column elements of the lower bottle case are receivable in the respective recess of the upper bottle case. Thus, the upper bottle case is applicable on the framework of the lower bottle case.

Alternatively, it would be feasible to configure the mechanism for offset stacking (rotated stacking), so that an upper case then moves into the nested position when it is arranged in the same orientation as a lower case. Only a rotation by 180° would facilitate an applied position.

For this embodiment, the column elements are configured so that a column element of a lower case can slide into a column element of an upper case. A respective reinforcement rib (in particular transversal rib) respectively in the column elements of the upper case could then be used as contact surface and limit the nesting position at the desired elevation.

For a rotated upper bottle case (rotated by 180° with reference to the nesting position about an axis vertically extending from the base), the column elements would not fit together anymore (depending on the configuration at least not all of them) and the case base of the upper case would simply rest on the column elements of the lower case or on their contact surfaces (applied position).

BRIEF DESCRIPTION OF THE DRAWINGS

Subsequently, a preferred embodiment of the invention is described with reference to the drawing figure, wherein.

DETAILED DESCRIPTION OF THE ILLUSTRATIVE EMBODIMENT

Figure 1:
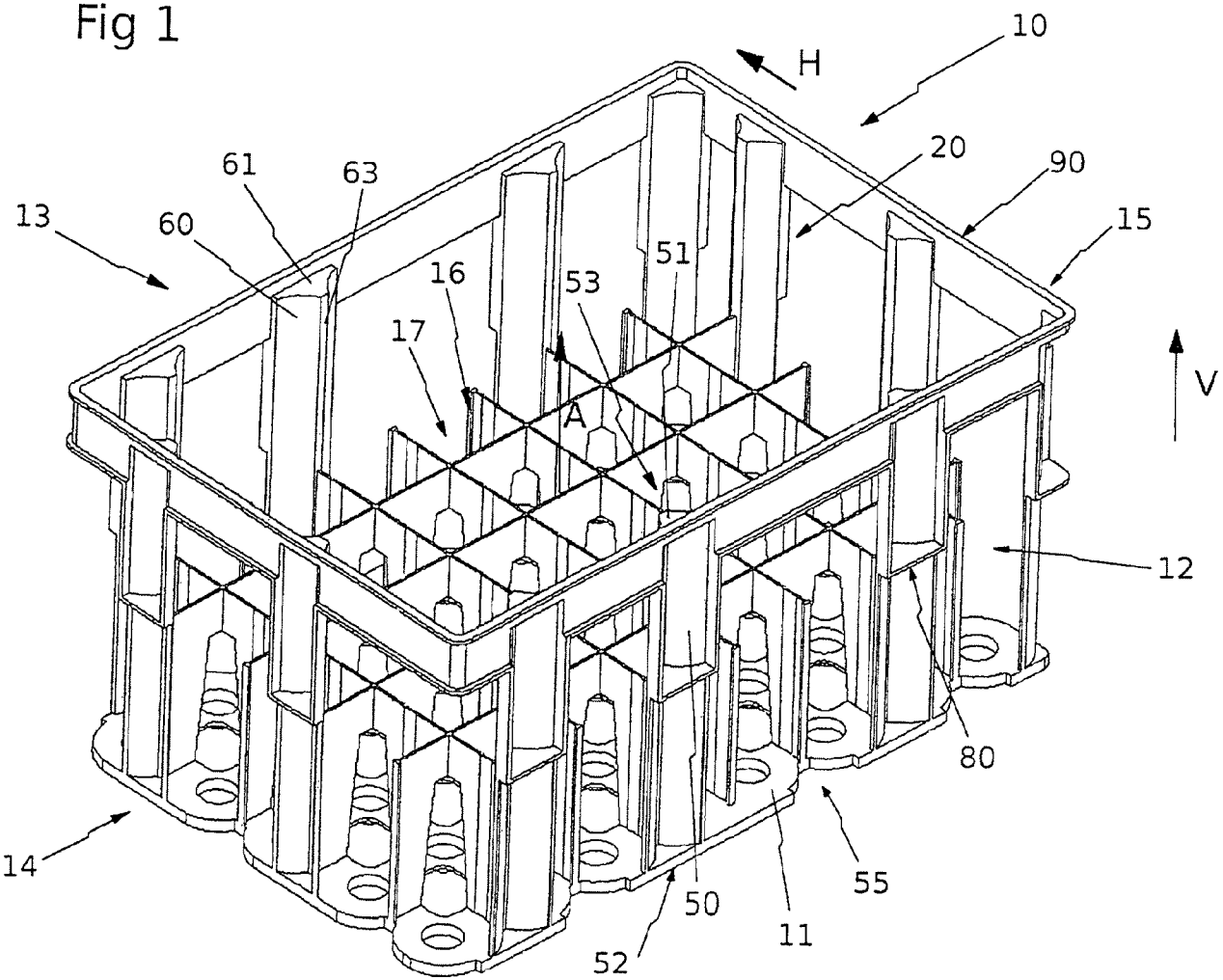
FIG. 1 illustrates a perspective view of a bottle case according to the invention.

In the subsequent description, the same reference numerals are used for identical or functionally equivalent elements.

Figure 4:
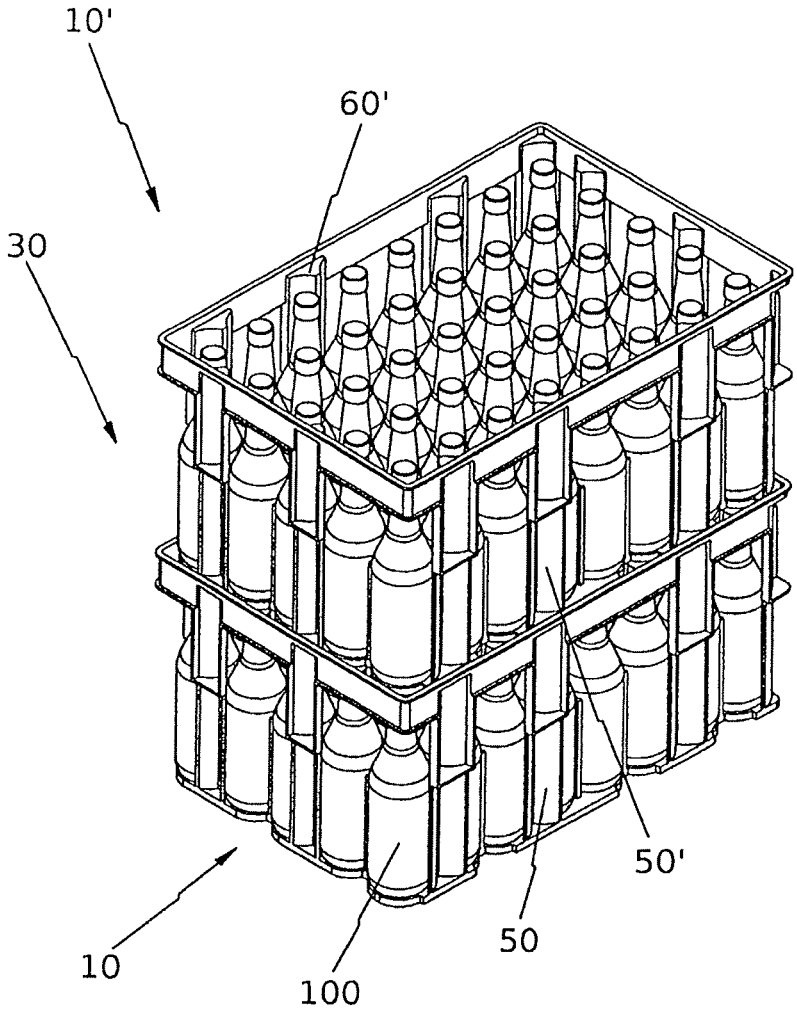
FIG. 4 illustrates a perspective view of two bottle cases according to the invention in applied position arranged in a stack on top of one another.

The bottle case 10 illustrated in FIG. 1 is made from a case base 11 with circumferentially arranged side elements (longitudinal side elements 12, 13, face side elements 14, 15), wherein a framework made from intersecting parallel compartment walls is arranged or configured within the case 10 on the case base 11 and between the side elements, wherein the framework defines respective compartments or bottle receiving compartments 17 in which, in the typical manner, bottles 100 (empty or filled, c.f. FIG. 4) can be inserted. These are secured within the framework 16 against falling over but also against hitting each other and thus received in a stable manner.

The open side elements 12, 13, 14, 15 are formed from column elements 50, 60 which are arranged at particular distances from one another. Only one column element 50 at the one longitudinal side element 12 and one column element 60 at the longitudinal side element 13 is respectively designated with the respective reference numeral or with the respective reference letter. At their face sides, the column elements are not provided with reference numerals for purposes of clarity. The column elements 50, 60 extend from the case base 11 during use, essentially in a vertical direction V from the case base 11 in upward direction and are connected with one another at an upper end with a frame element 90 essentially extending in horizontal direction H or around the case in use position.

The faces of the column elements 50, 60 are provided as contact surfaces 51, 52, 61, 62 over which additional bottle cases are stackable. Preferably the case is made from plastic material since this material is very light. In order to facilitate light weight construction, the column elements are configured as hollow columns, however respectively reinforced with a reinforcement rib 84 for stabilization. The respective reinforcement ribs are arranged as transversal ribs. The column elements form roof shaped elements in this embodiment with a triangular cross-section, wherein their gable or roof gable 53, 63 protrudes into an interior of the case (c.f. also FIG. 2*a*). Also other column shapes are conceivable, e.g. circular or semicircular or square.

The column elements 50, 60 are configured so that for example an upper case 10' is placed in a placement position 30 (e.g. FIG. 4) on a lower case 10 or in a nested position 40 (e.g. FIG. 5) in the lower case 10.

Figure 5:
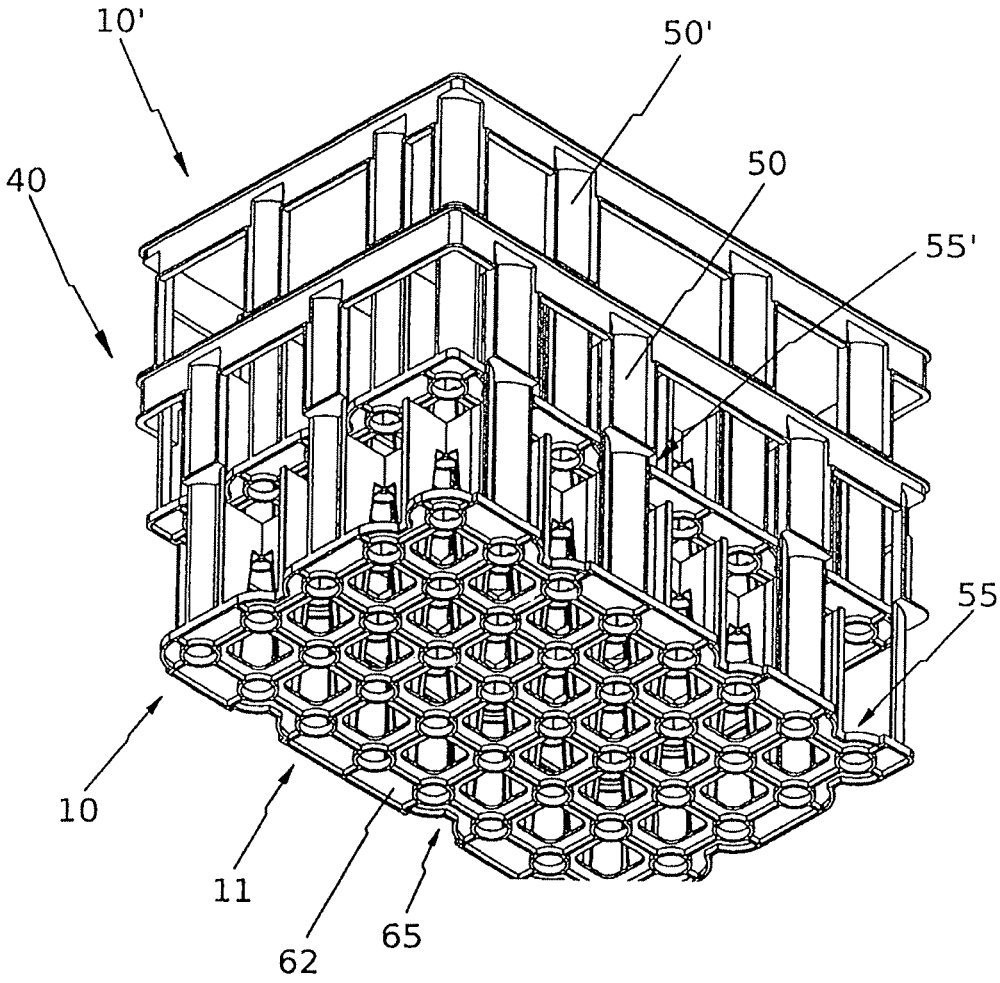
FIG. 5 illustrates a perspective view of two bottle cases according to the invention arranged in nested position on top of one another.

In this embodiment the column elements 50, 60 of two respective opposite side elements 12, 13 or 14, 15 are arranged opposite to one another, furthermore the case base 11 includes respective edge recesses 55, 65 for the recesses 65, c.f. FIG. 5, adjacent to the column elements 50, 60 which are also opposite to one another. Also here for the purposes of clarity only two recesses are designated, namely 55, 65.

Recesses, however, are also provided at the case base at the face side elements. The column elements and the recesses of a case thus form a mechanism 20.

In the placement position 30, the cases 10, 10' are stacked on top of one another with the same orientation, so that column elements 50', 60' of the upper case 10' rest on the column elements 50, 60 of the upper case 10 above their contact surfaces 51, 52 (only designated for the case 10 with reference numerals). As visible in FIG. 1, the column elements 50, 60 extend from the base 11 upward in vertical direction V, wherein the circumferential frame element 90 extends slightly beyond the column elements 50, 60. The upper case is thus only partially received in the lower case until it comes to rest with the case base 11', in particular with the lower contact surfaces of the column elements on the upper contact surfaces of the column elements of the lower case.

Though the placement position 30 it is possible to store empty product 100 (or also full bottles) in the bottle cases 10 or 10' while still facilitating a stacking of plural cases (FIG. 4).

In an orientation of the upper case 10' that is rotated by 180° relative to the lower case 10, the upper case 10' can be inserted deeper into the lower case 10 into the nested position 40. Since, as described supra, the column elements 50, 50', 60, 60' and the adapted recesses at the case base 11 are arranged opposite to one another at the respective opposite side elements, the upper case 10' that is rotated relative to the lower case 10 can penetrate the lower case 10 in that the column elements 50, 60 of the lower case 10 are received in the recesses 55' (c.f. FIG. 5) of the upper case 10' until the upper case 10' is placed on the framework 16 of the lower case 10. Thus, the mechanism 20 is configured so that respective column elements of the lower case can be brought into alignment with the respective recesses of the upper case when the upper case is rotated.

Figure 2A:
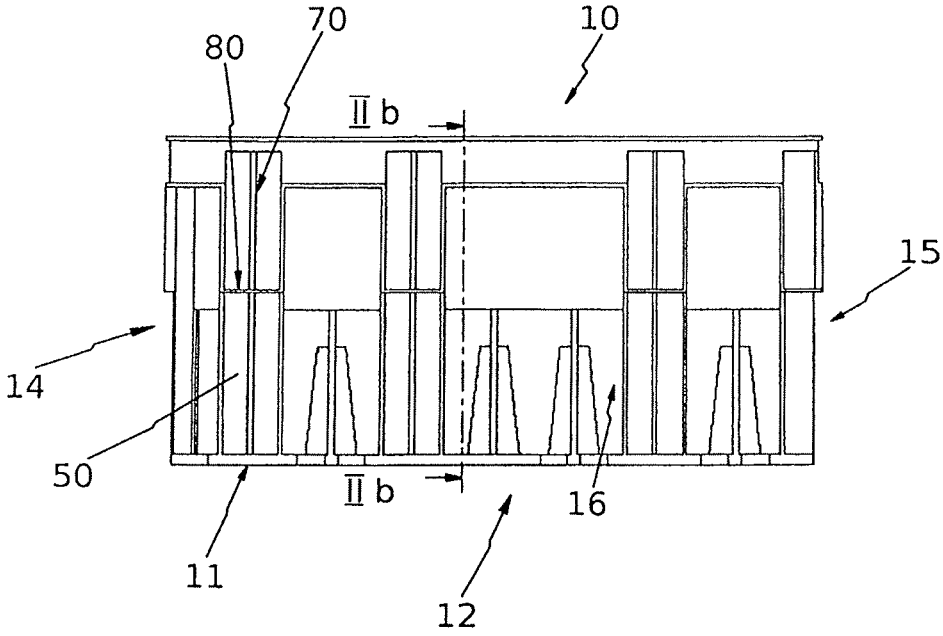
FIG. 2*a* illustrates a side view of the bottle case (longitudinal side)

FIG. 2*a* illustrates a side view of the bottle case 10, thus of one of the longitudinal side elements 12. Four column elements 50 are visible that are arranged in uneven distances from one another and the framework 16 is also visible. Three column elements form the side elements. One of the columns forms a corner portion of the case 10 (right side of figure).

Figure 2B:
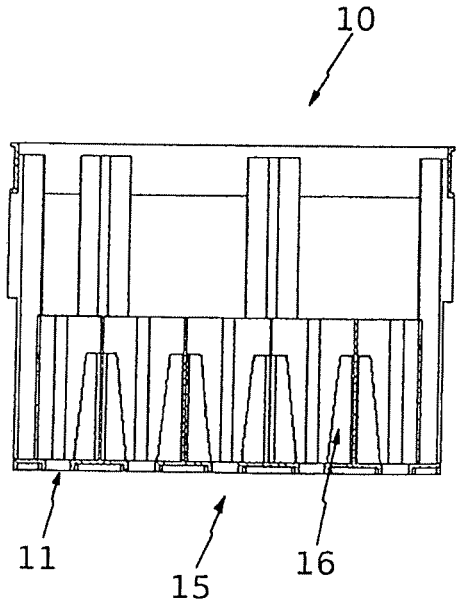
FIG. 2*b* illustrates a sectional view along the line IIb-IIb of FIG. 2*a* (face)

A section along the line IIb-IIb of FIG. 2*a* facilitates a sectional view of one of the side elements 15 in FIG. 2*b* from the interior of the case.

Figure 3A:
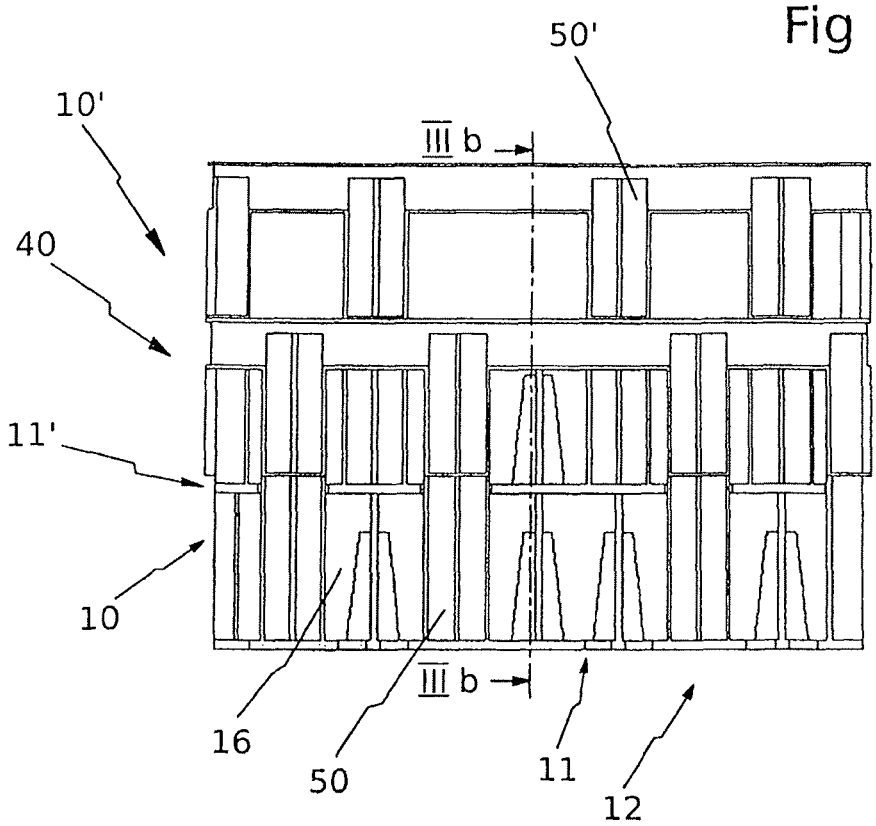
FIG. 3*a* illustrates a side view of two bottle crates according to the invention stacked on top of one another (longitudinal side; nesting position)

FIG. 3*a* also illustrates a side view of the bottle case 10 as illustrated in FIG. 2*a*, however herein an upper bottle case 10' is placed on the lower bottle case 10 in the nested position 40.

Figure 3B:
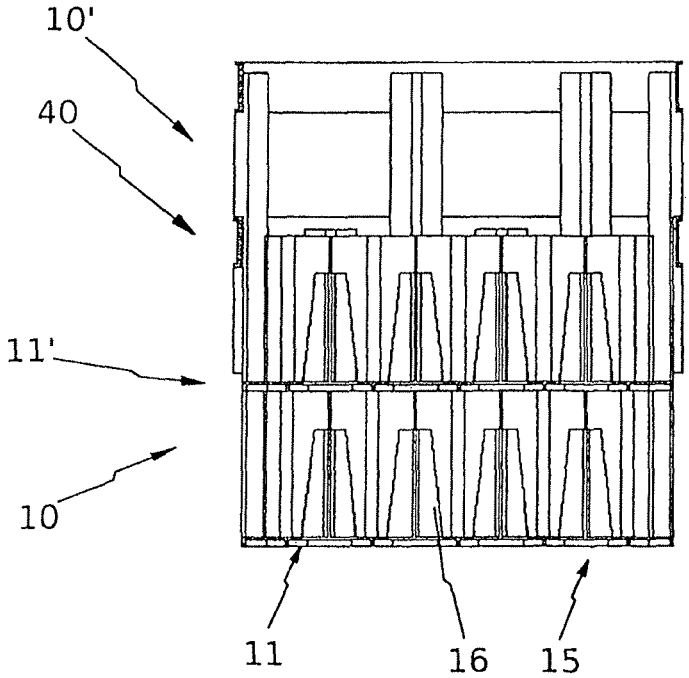
FIG. 3*b* illustrates a sectional view along the line IIIb-IIIb of FIG. 3*a* (face side; nesting position)

FIG. 3*b* illustrates a sectional view along the line IIIb-IIIb of FIG. 3*a*.

FIG. 4 illustrates a perspective view of two bottle cases 10, 10' stacked on top of one another in the placement position 30, wherein the bottles 100, for example empty product is received in the compartment 17 of the framework 16. The column elements of the upper case are arranged above the column elements of the lower case.

FIG. 5 illustrates a perspective view of two bottle cases 10, 10' stacked according to the invention in a nested position. Empty product cannot be received herein, however thus many cases can be stacked inside one another and can thus also be stored or transported in a space saving manner. Thus, the column elements of the upper case and the lower case do not contact one another anymore but are arranged adjacent to one another.

Figure 6:
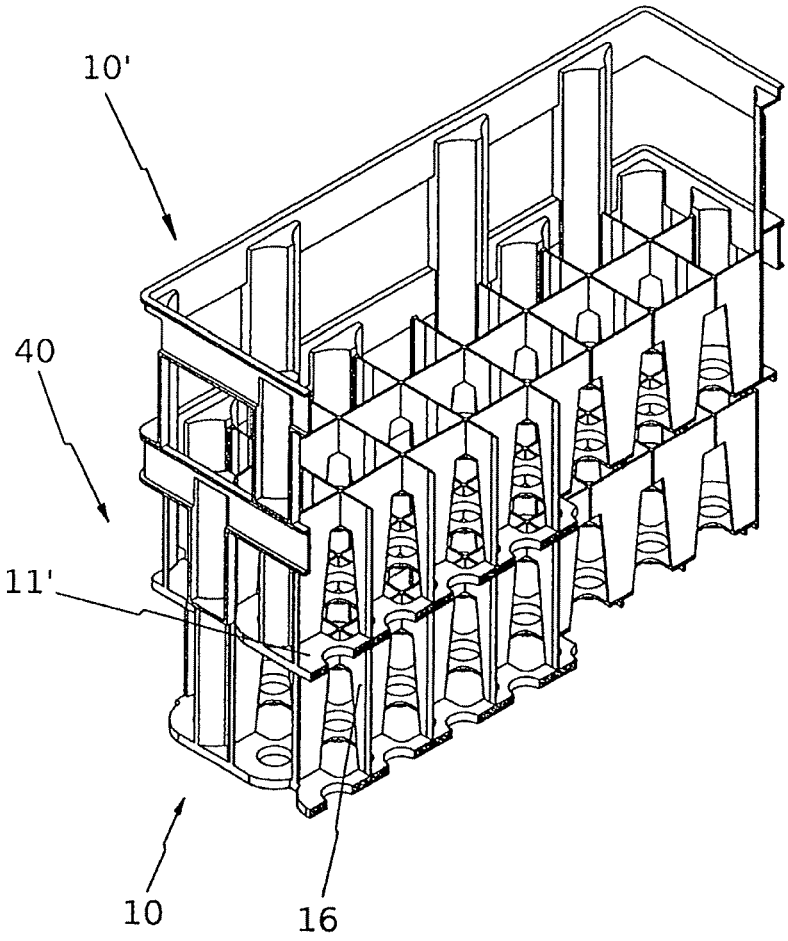
FIG. 6 illustrates another perspective view of two bottle cases according to the invention arranged on top of one another in nested position, wherein the case is illustrated in a sectional view.

FIG. 6 in turn illustrates two stacked bottle cases 10, 10', wherein a sectional view through the arrangement illustrates the inner configuration of the cases. The upper case 10' is then arranged in its nested position 40 with the case base 11' on the framework 16 of the lower case 10.

Figure 7:
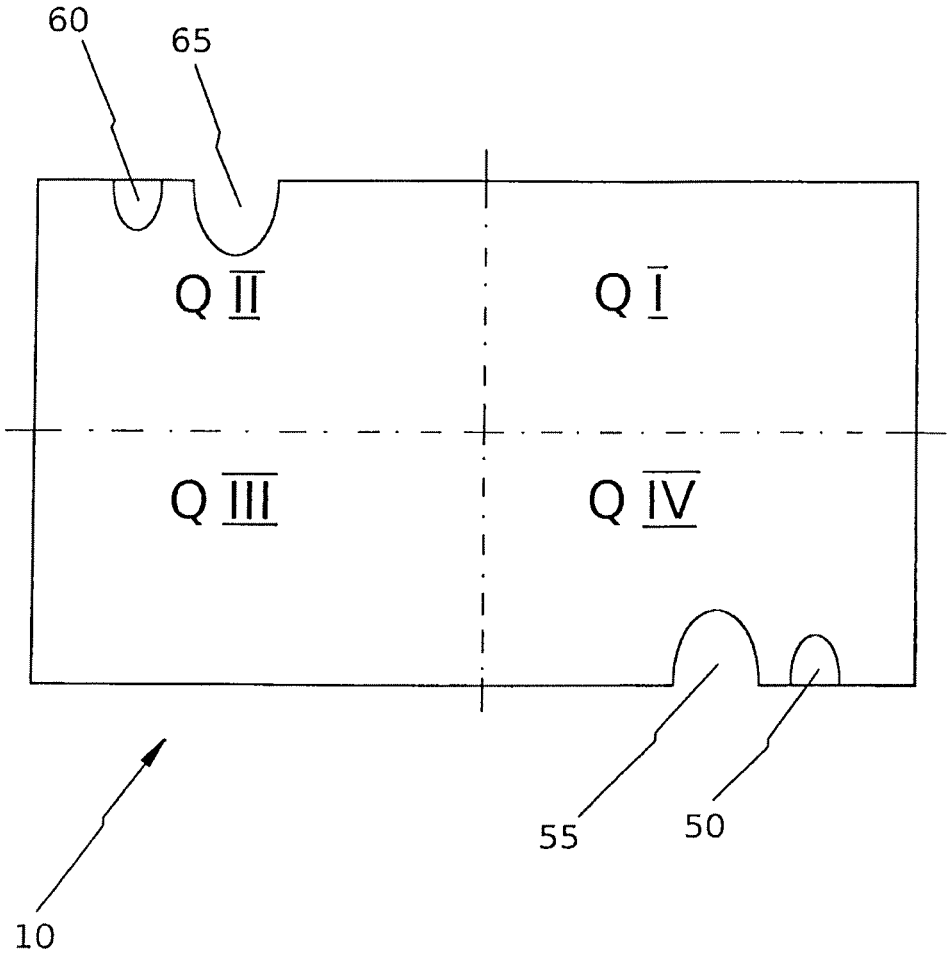
FIG. 7 illustrates a schematic top view of a bottle case in "minimal configuration."

FIG. 7 illustrates a schematic view of the bottle case, wherein a "minimum version" of column elements and recesses is illustrated. In the placement position (cases aligned uniformly) an upper case rests with its column elements on the column elements of the lower case in the nested position (upper case rotated by 180° with respect to the lower case). The column elements of the lower case are brought into alignment with the respective recesses of the upper case. When a case plane is divided into four quadrants according to a coordinates system, a column element recess-combination in a quadrant QII and a column element-recess-combination (viewed from the left to the right) in a quadrant QIV are provided. Also in the remaining quadrants QI and QII respective column elements and recesses can be provided.

It is appreciated that reference numerals are only stated in detail for the case 10 and only partially stated for the case 10' (the upper bottle case) since both cases are configured identical.

REFERENCE NUMERALS AND DESIGNATIONS

10 bottle case
10' bottle case
11 case base
11' case base
12 longitudinal side element
13 longitudinal side element
14 face side element
15 face side element
16 framework
17 compartment, bottle receiving compartment
20 mechanism
30 placement position
40 nesting position
50 column element
50' column element
51 upper contact surface
52 lower contact surface
53 roof gable
55 recess
55' recess
60 column element
60' column element
61 upper contact surface
62 lower contact surface
63 roof gable
65 recess
80 reinforcement rib
90 frame element
100 bottle, empty product
A axis
H horizontal direction
V vertical direction

The invention claimed is:

1. A bottle case (10, 10') comprising: a base, four side elements (12, 13, 14, 15) essentially extending from the base in vertical direction and a framework (16) with compartments for receiving bottles (100), wherein the bottle case (10, 10') furthermore includes a mechanism (20) at least at two opposite side elements (12, 13) and/or (14, 15) and at the case base (11, 11') for stacking plural bottle cases (10, 10') in a rotated arrangement, wherein the mechanism is configured so that an upper bottle case (10')

is applicable to a lower bottle case (10) in a placement position; and is insertable into the lower bottle case (10) in a nesting position (40) in an orientation that is rotated about a vertical axis (A) preferably by 180° with respect to the placement position (30), wherein the mechanism includes at least one column element (50, 50' 60, 60') protruding into an interior of the case respectively at least at two side elements arranged opposite to one another, and at least one edge recess (55, 65) at the case base (11, 11') respectively arranged at the two side elements arranged opposite to one another, wherein the edge recess is adapted to the column element, wherein the column element and the recess of each side element are arranged so that in the placement position (30) the column elements (50', 60') of the upper bottle case (10') are alignable with the column elements (50, 60) of the lower bottle case (10) so that the column elements (50', 60') of the upper bottle case (10') are applicable to the column elements (50, 60) of the lower bottle case (10) and in the nesting position (40) the column elements (50, 60) of the lower bottle case (10) are alignable with the respective recesses of the upper bottle case (10') and are thus receivable in the respective recess of the upper bottle case (10'), wherein the column elements (50, 50' 60, 60') essentially form the side elements (12, 13, 14, 15) of the bottle case (10, 10'), wherein the column elements are connected with one another through a circumferential frame element (90) at an upper end of the bottle case, wherein the side elements (12, 13, 14, 15) are configured open.

2. The bottle case according to claim 1, wherein the mechanism (20) is configured so that the lower and the upper bottle case (10, 10') in the placement position (30) are in the same orientation relative to one another and are arranged in a rotated orientation relative to one another in the nested position (40).

3. The bottle case according to one of the claim 1, wherein the upper bottle case (10') is applicable to the framework (16) of the lower bottle case (10), or wherein at least one contact element is provided which prevents the upper bottle case from contacting the framework of the lower bottle case in the nested position.

4. The bottle case according to claim 1, wherein at least two or a plurality of column elements are arranged at each of the two opposite side elements, and wherein at least two or a plurality of the recesses adapted to the column elements include edge recesses (55, 65) at the case base (11, 11') at each of the two side elements that are arranged opposite to one another.

5. The bottle case according to claim 1, wherein the column elements (50, 50', 60, 60') extends from the base (11, 11') essentially in vertical direction (V) upward, wherein the lower and the upper face sides of the column element are respectively configured as contact surfaces (51, 52, 61, 62).

6. The bottle case according to claim 1, wherein the column element is configured as a hollow column element, preferably with a triangular cross section in particular preferably with a roof shaped structure whose roof gable (53, 63) is oriented into the interior of the bottle case (10, 10').

7. The bottle case according to claim 6, wherein the hollow column element includes at least one reinforcement rib (80) in its interior.

8. The bottle case according to claim 1, wherein the height of the frame work (16) is less than one half of the height of the side elements (12, 13, 14, 15) of the bottle case (10, 10'), preferably 0.2 times to 0.4 times the height of the side element.

9. The bottle case according to claim 1, wherein the bottle case is made from a plastic material.

* * * * *